United States Patent [19]

Dorren

[11] 4,061,882

[45] Dec. 6, 1977

[54] QUADRATURE MULTIPLYING FOUR-CHANNEL DEMODULATOR

[75] Inventor: Louis Dorren, San Mateo, Calif.

[73] Assignee: Quadracast Systems, Inc., San Mateo, Calif.

[21] Appl. No.: 714,034

[22] Filed: Aug. 13, 1976

[51] Int. Cl.[2] ..... H04H 5/00

[52] U.S. Cl. ..... 179/15 BT

[58] Field of Search ..... 179/15 BT, 1 G, 1 GQ, 179/100.1 TD, 100.4 ST; 325/36

[56] References Cited

U.S. PATENT DOCUMENTS

| | | | |
|---|---|---|---|
| 3,721,766 | 3/1973 | Hilbert | 179/15 BT |
| 3,881,063 | 4/1975 | Mawake et al. | 179/15 BT |
| 3,909,539 | 9/1975 | Ohkubo et al. | 179/15 BT |
| 3,965,302 | 6/1976 | Kurata | 179/15 BT |
| 3,967,069 | 6/1976 | Dorren | 179/15 BT |
| 3,980,832 | 9/1976 | Nakamura et al. | 179/15 BT |
| 3,985,964 | 10/1976 | Ohkubo et al. | 179/15 BT |

*Primary Examiner*—Douglas W. Olms
*Attorney, Agent, or Firm*—Robert G. Slick

[57] ABSTRACT

A decoder is provided for a FM radio four-channel system having the usual 19 kHz pilot signal, a first subcarrier at 38 kHz, a second subcarrier in quadrature therewith, and another subcarrier at 76 kHz. The decoder of the present invention is a time division system wherein the 19 kHz pilot signal is doubled and the phase shifted 90°. This produces sine and cosine 38 kHz signals to provide a first pair of outputs, and each of these signals is inverted to provide a second pair of outputs. By properly adding the four outputs thus derived, switching signals are provided to decode the four channel information.

5 Claims, 13 Drawing Figures

QUADRATURE MULTIPLYING FOUR-CHANNEL DEMODULATOR

SUMMARY OF THE INVENTION

The present invention relates to an improvement of the inventions in my U.S. Pat. Nos. 3,708,623 and 3,798,377. In the first of said patents, a novel system is described for providing a four channel or quadraplex FM system which is fully compatible with existing FM mono and stereo equipment. In the second of said patents, the four channel signal is demodulated utilizing a one-of-four decoder.

According to the system to which the present invention is applicable, a main channel is provided which extends from 50 Hz to 15 kHz, containing the sum of all four elements of the information. In addition, the composite signal contains a 19 kHz pilot, a first subchannel centered at 38 kHz containing two carriers in quadrature, the sine carrier containing (LF+LB−RF−RB) and the cosine carrier containing (LF−LB−RF+RB) and a second subchannel centered at 76 kHz containing (LF−LB+RF−RB) information. The call-outs of the specific information contained on the various carriers is for illustration purposes only since the information could be sent in any order.

In accordance with the present invention, such a signal can be demodulated by doubling the 19 kHz pilot to provide a 38 kHz sine wave, shifting the phase to provide a 38 kHz cosine wave and inverting each of the waves to provide four signals, namely a 38 kHz wave, a wave 180° out of phase therewith, a cosine wave of 38 kHz, and a wave 180° out of phase with the cosine wave. This gives four output waves or signals which can be added in proper sequence to provide the desired four switching signals to decode all four channels of information.

The present invention is an improvement over the decoding systems previously described in that it may use a simple frequency doubler and phase offset circuit to generate the switching signals. Thus it is not necessary to generate high frequency signals in the decoder. The cost of the system described and claimed herein is substantially less than other known systems since it uses a minimum of components and these components are all well known and readily available.

DESCRIPTION OF THE PREFERRED EMBODIMENTS

The composite signal which is handled in accordance with the present invention is well known from U.S. Pat. No. 3,708,623 and will be described only briefly. In connection with the following description, the terms "left and right" and "front and back" are used to describe the four signals but it will be understood that the signals are not necessarily sent in this order and that the channels could be as easily numbered 1, 2, 3 and 4 and that calling out the signals by these names is merely for the purpose of simplifying the discussion.

The signal itself consists of a main channel going from 50 Hz to 15 kHz from the carrier frequency and this main channel carries all four signals and is the one which would normally be received by a mono receiver. The usual 19 kHz pilot signal is provided and above this is a first subchannel centered at 38 kHz containing two subcarriers in quadrature, namely a first or sine subcarrier and a second or cosine subcarrier, of which the first carrier contains the (LF+LB−RF−RB). In normal stereo systems, the main channel and the first subchannel carrier would be demodulated to provide the usual stereo information. The cosine subcarrier contains the information (LF−LB−RF+RB). A second subchannel centered at 76 kHz is provided containing the (LF−LB+RF−RB) information and in the case of a quadraplex receiver this, in conjunction with the two subcarriers in the first subchannel and the main channel information enables one to separate each of the four audio channels. A SCA may or may not be used and has no bearing on the present invention.

Figure 1:
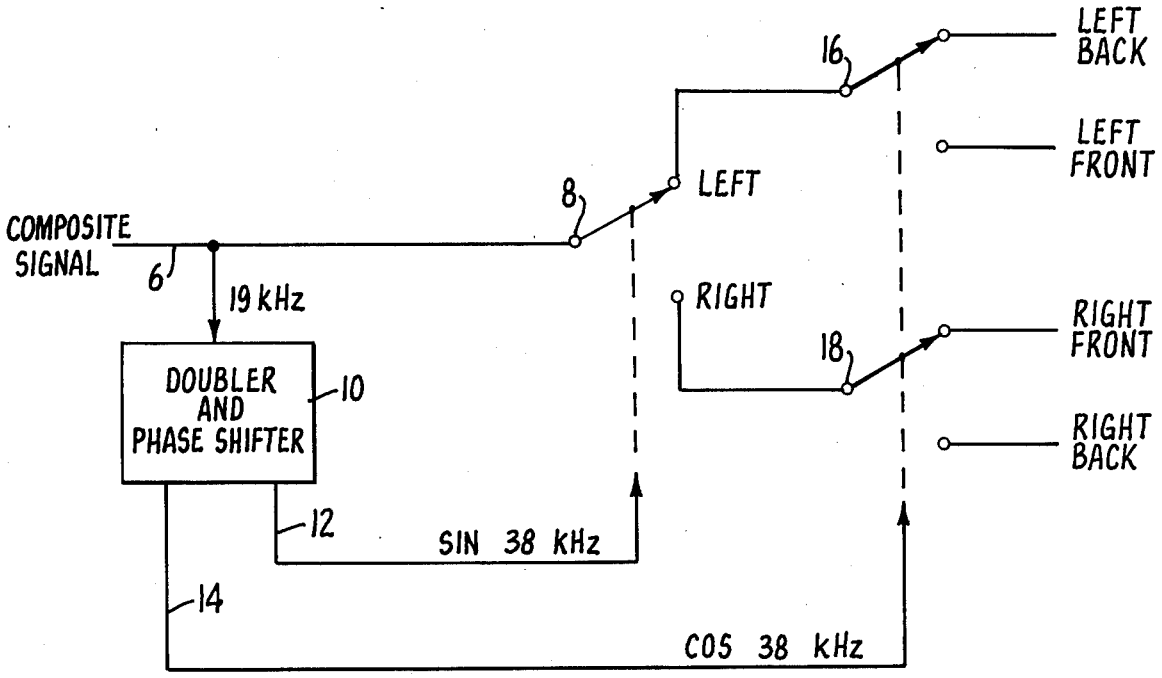
FIG. 1 is an electro-mechanical switch analogy of the decoding process.

The basic decoding system is best seen by reference to FIG. 1. The composite signal containing all four information channels, including the pilot and the first and second sub-channels, is brought in through line 6. A portion of this signal goes to switch 8, the function of which will be later described, while the 19 kHz pilot is extracted and passed to the doubler and phase shifter 10 wherein two signals are generated, namely, a sine 38 kHz signal which passes through line 12, and a cosine 38 kHz signal which passes through line 14. The sine 38 kHz signal is used to actuate the gate 8 where it separates the left from the right information. The cosine 38 kHz signal is used to actuate the gates 16 and 18, wherein the back and front signals are extracted from the left and right signals. For the purposes of this explanation, switch 8 is in its upper position when the sine signal is high, while switches 16 and 18 are in the upper position when the cosine signal is low.

Figure 2:
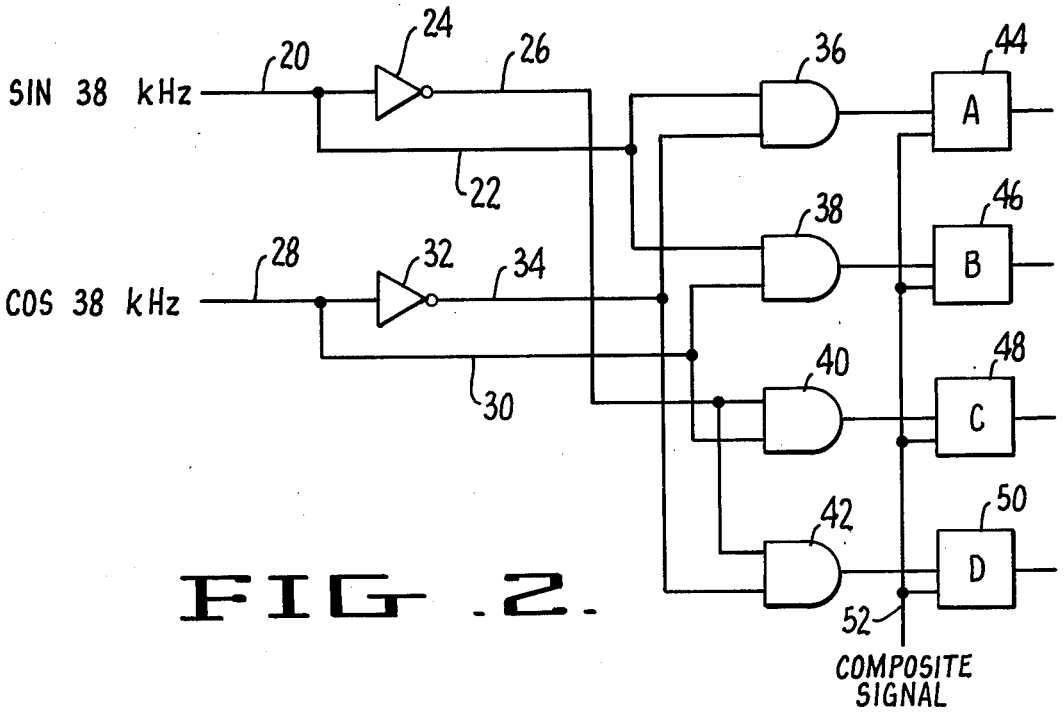
FIG. 2 is a simplified diagram of a practical circuit.

The practical way in which this is accomplished is shown in the simplified schematic diagram of FIG. 2. Here the sine signal at 38 kHz is brought in through the line 20 and a portion is taken off through line 22 while another portion is passed through the amplifier — inverter 24 so that the signal in line 22 is 180° out of phase with that in line 26. Similarly, the cosine signal is introduced through line 28 and a portion is taken off directly through line 30. Another portion is passed through the amplifier — inverter 32 so that the output on line 34 is 180° out of phase with that of line 30. The four outputs, namely lines 22, 26, 30 and 34, are now fed to the four AND gates 36, 38, 40 and 42. The output from each AND gate is fed through a switch, respectively 44, 46, 48 and 50. Line 52 introduces the composite signal into each of these switches so that if the operation of switches is properly timed, output from the switches will represent the four demodulated signals.

Figure 3:
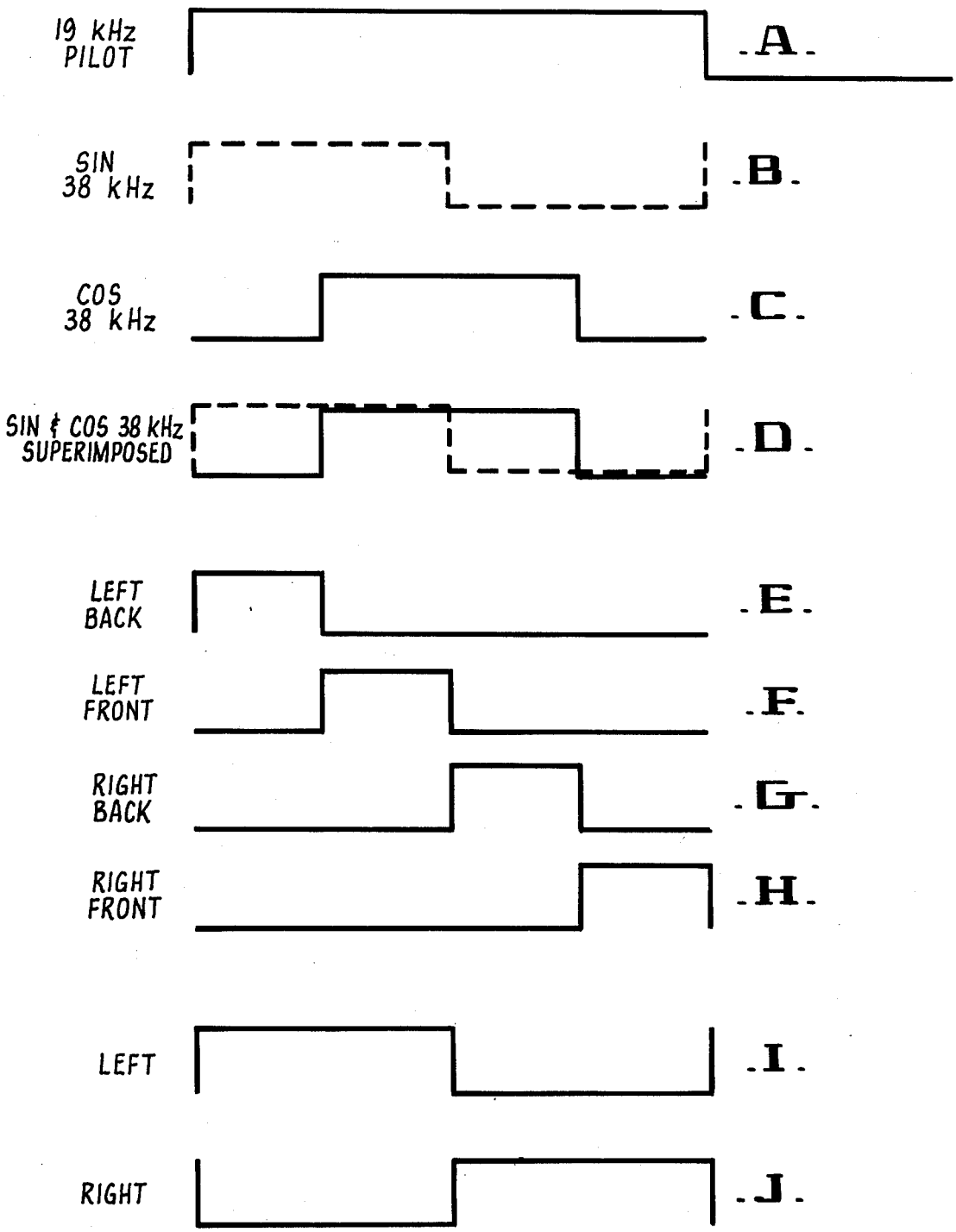
FIGS. 3A through 3J show the various curves which are detected and generated during the decoding process.

In this connection, reference is made to FIG. 3 wherein curve A represents the 19 kHz pilot signal, curve B the 38 kHz sine signal, and curve C the 38 kHz cosine signal. The inverted sine and cosine signals are not shown, but it will be understood that these signals are 180° out of phase with the signals shown. Now when one superimposes the sine and cosine signals, one gets the curve shown at D.

Referring back to FIG. 2, when the sine is high and the inverted cosine is high, these signals (lines 22 and 34) are fed to AND gate 36 which will actuate switch 44 to give the left back signal of FIG. 3(E). Now as the sine stays high and the cosine goes high, these signals (lines 22 and 30) are fed to AND gate 38 to actuate switch 46, giving the left front signal of FIG. 3(F). Now the cosine stays high, but the sine goes low and the inverted sine signal through line 26 and the cosine signal of line 30 activates AND gate 40 which in turn closes switch 48, giving the right back signal of FIG. 3(G). During the next quarter cycle, the sine signal stays low while the cosine signal goes low and the inverted sine signal and the inverted cosine signal are fed to AND gate 42, closing switch 50. This yields the right front information as is shown in curve 3(H).

It will be apparent from the above, that by properly selecting direct and inverted outputs of the sine and cosine signal, AND gates may be activated, demodulating the four-channel information. Although a square wave system has been shown for purposes of illustration, sine waves or other waveforms could also be used but it is important that in each case the signals have a 50% duty cycle, since otherwise the system would become unbalanced and switching would take place at an improper place.

Figure 4:
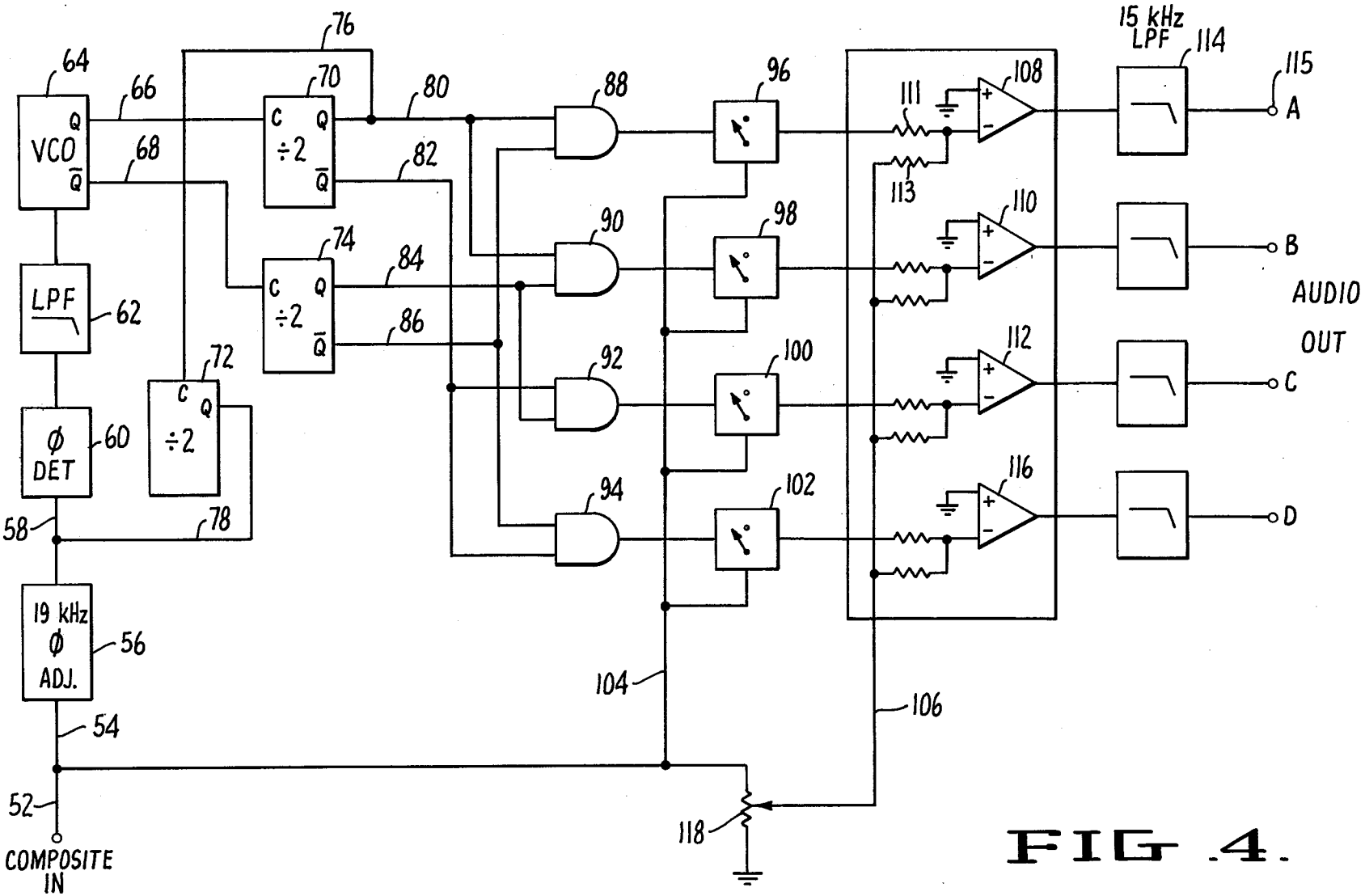
FIG. 4 is a block diagram of a complete four channel decoder utilizing the switch decoders of the present invention and a PLL circuit and dividers for generating the switching signals.

A practical circuit for carrying out the purposes of the present invention is shown in FIG. 4. This particular circuit uses a phase lock loop, but as will be later apparent, this is just one example of the method by which the desired switching signals can be generated.

In the switching arrangement of the present invention, harmonics are generated in the decoded outputs so that these outputs do not have perfect separation. The harmonics represent out of phase cross talk and can be easily cancelled by adding some inphase composite signal to the outputs. FIG. 4 makes provision for the cancellation of cross talk as well as for the basic demodulation.

Referring now to the drawings by reference characters, the composite signal is introduced through line 52 and a portion of this signal is taken through line 54 to the pilot phase adjust circuit 56. The output is fed through line 58 to the phase detector 60 and then to a low pass filter 62 and to a voltage controlled oscillator (VCO) 64 which has a Q output through line 66 and a $\overline{Q}$ output in line 68. Three flip-flops of the toggle variety are employed, namely 70, 72 and 74. Each of the flip-flops has a clock input designated C and the usual Q and $\overline{Q}$ outputs. VCO 64 has a nominal free-running frequency of 76 kHz and the Q output is taken through line 66 divided by 2 in the flip-flop 70 and the Q output taken through line 76 to the clock input of flip-flop 72 whereupon it is again divided by 2 to give the 19 kHz frequency of the pilot. This is taken through line 78 and fed back through the phase detector 60 through line 58. This is the usual PLL circuit and in this instance the free-running frequency is four times that of the incoming frequency.

The Q output from flip-flop 70 is also taken through line 80 and is the 38 kHz sine signal. The $\overline{Q}$ output through line 82 is the inverted 38 kHz sine signal.

The inverted or $\overline{Q}$ output from VCO 64 is taken through line 68 to flip-flop 74, where it is divided by 2 and the Q signal through line 84 represents the 38 kHz cosine signal while the $\overline{Q}$ output through line 86 represents the inverted 38 kHz cosine signal. Thus there are provided four 38 kHz signals, each of which is 90° out of phase with another of the signals. These signals are then fed to the AND gates 88, 90, 92 and 94 which correspond in sequence and function to the AND gates 36, 38, 40 and 42, respectively, previously described in connection with FIG. 2. The outputs from these AND gates are fed to the switches 96, 98, 100, 102, which correspond respectively with the switches 44, 46, 48 and 50 of FIG. 2, while the composite signal is fed to each of these switches through line 104. Thus, the output from each of the switches will represent one of the four decoded signals.

As was previously mentioned, there is some generation of harmonics in the switching process which produces cross talk, i.e. incomplete separation of each of the four channels of information. This cross talk can be cancelled by blending in a small amount of the composite signal into the output of each channel. Thus, a small portion of the composite signal is introduced through line 106 to the amplifier 108 through the resistor network 111 and 113. The output from amplifier 108 is passed through a 15 kHz low-pass filter 114 to remove any higher frequency components introduced by the switching process and the output A designated 115 represents the left-back information. The amount of composite signal introduced is controlled by the potentiometer 118 to secure the exact balance desired.

In a similar manner, the switched signal and composite signal are introduced through amplifiers 110, 112 and 116, pass through low-pass filters to give the four audio output channels designated A, B, C and D in FIG. 4. In this manner, the four channel signal is decoded using relatively simple common standard components.

Although in FIG. 4 a PLL circuit has been shown for generating the sine and cosine and inverted signals, other systems can be used. For instance, the 19 kHz signal might be merely multiplied by four to give Q and $\overline{Q}$ output corresponding to the outputs on lines 66 and 68. Other means of generating the switching signals are well known to those skilled in the art.

Although it is ordinarily preferred to use a square wave signal in order for maximum power output, sine wave signals or other waveforms can be used as well but, in any instance, it is important that a signal having 50% duty cycle be employed.

I claim:

1. A decoder for composite FM signal wherein the composite signal has a main channel having first, second, third and fourth bits of information thereon, a pilot signal removed from said main channel, a first subchannel having a frequency twice that of said pilot signal having two carriers in quadrature thereon, namely, a sine carrier containing plus first plus second minus third minus fourth information and a cosine carrier containing plus first minus second minus third plus fourth information thereon and a second subchannel at a frequency twice that of said first subchannel containing plus first minus second plus third minus fourth information thereon, wherein the improvement consists of a means of demodulating the above-described four channel composite signal, such means comprising in combination:

a. means for extracting said pilot signal;

b. means for doubling said pilot signal to yield a first switching signal representing the sine carrier of the first subchannel;

c. means for inverting said first signal to provide a second switching signal 180° out of phase with said first switching signal;

d. means for doubling and shifting the phase of said pilot signal to provide a third switching signal 90° out of phase with said first switching signal representing the cosine carrier of said first subchannel;

e. means for inverting said third signal to provide a fourth switching signal 180° out of phase with said third switching signal;

f. first, second, third and fourth AND gates, g. four switches, each switch being actuated by one of said AND gates, said switches being connected to switch said composite signal to four outputs;

h. means for feeding the first and fourth switching signals to the first AND gate;

i. means for feeding the first and third switching signals to the second AND gate;

j. means for feeding the second and third switching signals to the third AND gate;

k. means for feeding the second and fourth switching signals to the fourth AND gate whereby, l. the output of each of said switches represents one of said bits of information.

2. The decoder of claim 1 wherein said main channel occupies the spectrum of 50 Hz to 15 kHz, the pilot signal is at 19 kHz, the first subchannel is at 38 kHz and the second subchannel is at 76 kHz.

3. The decoder of claim 1 wherein the output of each of said switches is passed through a low pass filter to attenuate frequencies higher than 15 kHz.

4. The decoder of claim 1 wherein a small amount of the composite signal is mixed with the output of each of said switches and having means to control the amount of said composite signal which is mixed with the output of each of said switches.

5. The decoder of claim 1 wherein said pilot signal is employed to actuate a PLL circuit, said PLL circuit including a VCO operating at a nominal frequency of four times that of the pilot signal, said VCO having a Q output and a $\overline{Q}$ output and developing said switching signals as follows:

a. dividing said Q output by 2 to develop said first switching signal, b. inverting said first switching signal to provide said second switching signal, c. dividing said $\overline{Q}$ output by 2 to develop said third switching signal, and d. inverting said third switching signal to develop said fourth switching signal.

* * * * *